US006071150A

United States Patent [19]

Tang et al.

[11] Patent Number: 6,071,150

[45] Date of Patent: Jun. 6, 2000

[54] EXTENDER FOR USE WITH COMPUTER INTERNAL STRUCTURE

[75] Inventors: Chiu-Yu Tang, San Jose, Calif.; Jerry Wu, Chang-Hua Hsien; George Lee, Taipei, both of Taiwan; Lee-Ming Cheng, Cupertino, Calif.

[73] Assignee: Hon Hai Precision Ind. Co., Ltd., Taipei Hsien, Taiwan

[21] Appl. No.: 08/904,193

[22] Filed: Jul. 31, 1997

[51] Int. Cl.[7] ..... H01R 25/00

[52] U.S. Cl. ..... 439/638

[58] Field of Search ..... 439/638, 660, 439/653, 76.1, 101

[56] References Cited

U.S. PATENT DOCUMENTS

| | | | |
|---|---|---|---|
| 4,857,002 | 8/1989 | Jensen et al. | 439/76 |
| 4,997,376 | 3/1991 | Buck et al. | 439/660 |
| 5,547,385 | 8/1996 | Sprangler | 439/101 |
| 5,620,331 | 4/1997 | Los et al. | 439/76.1 |

*Primary Examiner*—Neil Abrams
*Assistant Examiner*—J. F. Duverne

[57] ABSTRACT

An extender (10) comprises a first, male section (12) and a second, female section (14) adapted to be back-to-back assembled. A pair of latches devices (39, 52) are provided on both opposite ends of the male section (12) and female section (14) for fastening the male section (12) and the female section (14) together. A plurality of first passageways (32) are formed in the male section (12) and a corresponding number of second passageways (58) are formed in the female section (14) wherein each of the first passageways (32) cooperates with the aligned corresponding second passageway (58) to form a contact receiving passage for receiving a corresponding contact (80) therein. A pair of grounding tangs (70) are disposed at two opposite ends of the extender (10) wherein each grounding tang (70) comprises an outward facing first portion (72) positioned in the male section (12), and an inward facing second portion (74) positioned in the female section (14). Therefore, the female section (14) of the extender (10) can be coupled to the male connector mounted on the hard drive and the male section (12) of the extender (10) can be coupled to the female connector mounted on the backplane for cooperatively electrically connecting the hard drive to the backplane.

8 Claims, 8 Drawing Sheets

EXTENDER FOR USE WITH COMPUTER INTERNAL STRUCTURE

BACKGROUND OF THE INVENTION

1. Field of the Invention

The invention relates to an electrical device for use within a computer, and particularly to an extender having two opposite connection ports adapted to be respectively coupled to a female connector mounted on a backplane and a male connector mounted on the hard drive.

2. The Related Art

U.S. Pat. No. 5,547,385 discloses a pair of blind mating male and female connectors, which are called as SCA-II connectors. In the recent years, such female connector is mounted on a backplane in the computer and such male connector is mounted to a hard drive which is intended to be attached to the backplane for establishing signal transmission between the hard drive and the backplane through the interconnection of such female and male connectors. Ideally, the relative positions of the backplane and the hard drive should be precisely arranged so that the hard drive can be properly and correctly connected to the backplane through such pair of male and female connectors. Unfortunately, because there is no unique specification regulated around the connection area of the hard drive, different hard drive manufacturers may have the male connector located on the connection area with two different positions wherein one of the first type hard drive is flush with the edge of the hard drive and the other of the second type hard drive is somewhat indented from the edge for complying the different existing computer chassis structures.

The present problem the computer manufacturer confronts, is that his computer interior structure substantially requires a first type hard drive to comply with, while his selected qualified hard drive manufacturer only can provide the second type hard drive for him. Under this situation, a significant gap exists between the un-mated male connector of the hard drive and female connector of the backplane even though the hard drive reaches its final predetermined secured position. Accordingly, an extender intermediating the male and female connectors and making a bridge over such gap, is desired for compensation.

Therefore, an object of the invention is to provide an extender adapted to mate the male SCA-II connector and the female SCA-II connector, respectively, on two opposite sides, so as to compensate the original gap and accomplish the electrical connection from the hard drive through the extender to the backplane.

SUMMARY OF THE INVENTION

According to an aspect of the invention, an extender comprises a first, male section and a second, female section adapted to be back-to-back assembled. A pair of latches devices are provided on both opposite ends of the male section and female section for fastening the male section and the female section together. A plurality of first passageways are formed in the male section and a corresponding number of second passageways are formed in the female section wherein each of the first passageways cooperates with another aligned corresponding second passageway to form a contact receiving passage for receiving a corresponding contact therein. A pair of grounding tangs are disposed at two opposite ends of the extender wherein each grounding tang comprises an outward facing first portion positioned in the male section, and an inward facing second portion positioned in the female section. Therefore, the female section of the extender can be coupled to the male connector mounted on the hard drive and the male section of the extender can be coupled to the female connector mounted on the backplane for cooperatively electrically connecting the hard drive to the backplane.

DETAILED DESCRIPTION OF THE PREFERRED EMBODIMENTS

Figure 1:
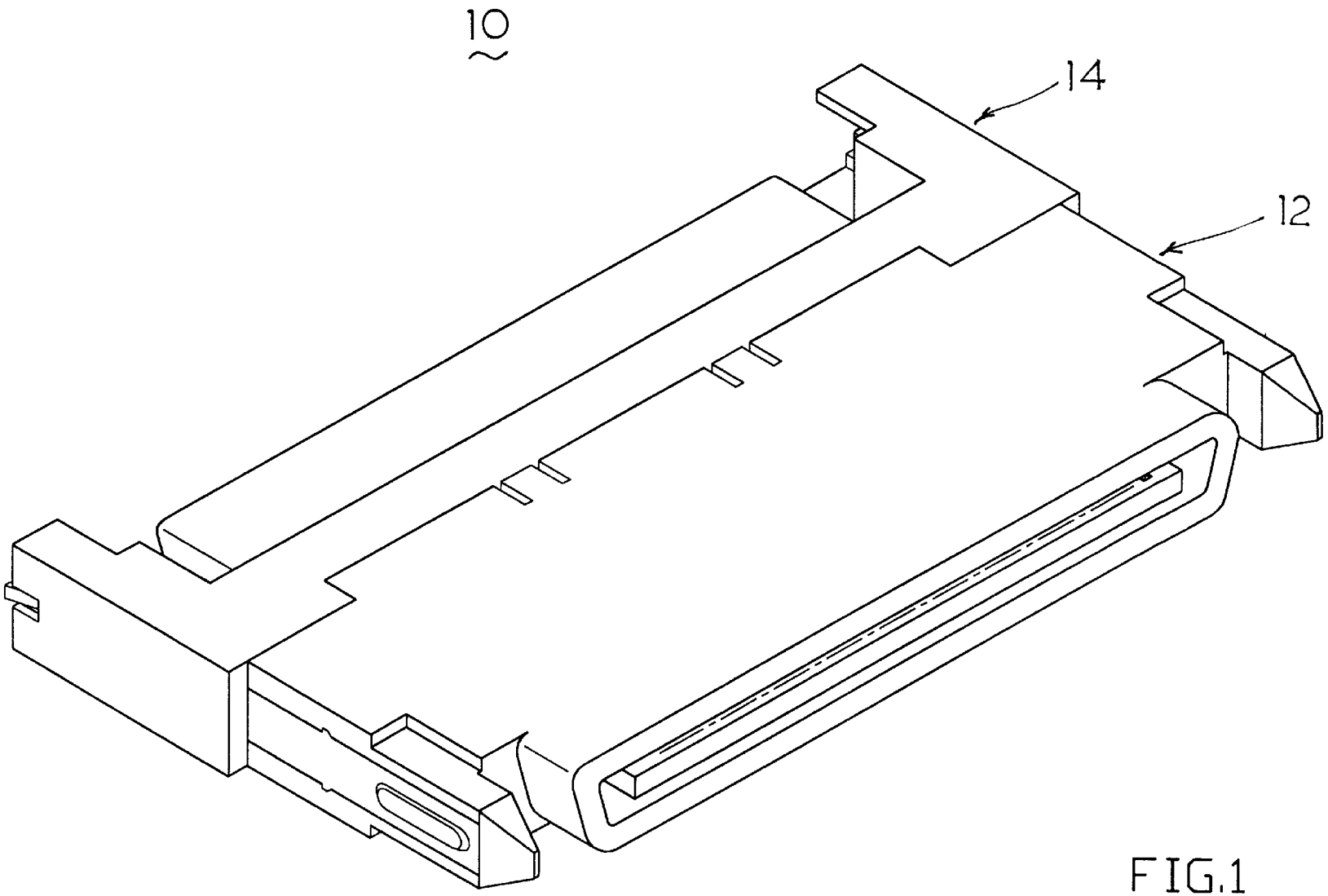
FIG. 1 is a perspective view of a presently preferred embodiment of an assembled extender, without contacts and grounding tangs therein, for intermediating a male connector on a hard drive and a female connector on a backplane, according to the invention.

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

It will be noted here that for a better understanding, most of like components are designated by like reference numerals throughout the various figures in the embodiments. Attention is directed to FIGS. 1–5 wherein an extender 10 includes a male section 12 and a female section 14.

Figure 4:
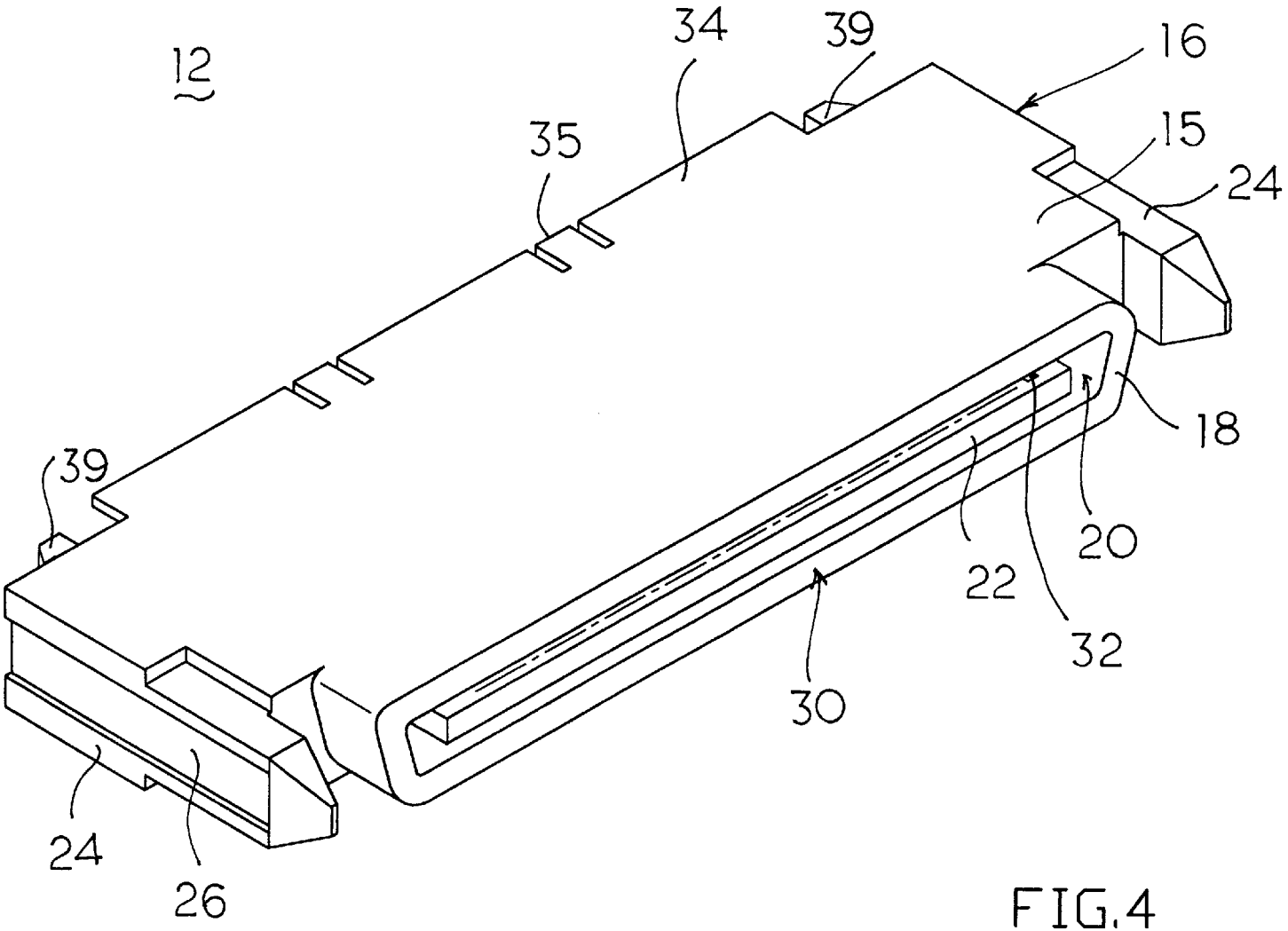
FIG. 4 is a front perspective view of the male section of the extender of FIG. 1.

Also referring to FIG. 4, the male section 12 includes a first housing 16 with a first base 15 having a first circumferential wall 18 extending therefrom and defining a first cavity 20 with a blade 22 suspensively extending horizontally within the cavity 20. A pair of alignment posts 24 are disposed adjacent two opposite ends of the housing 16, each of which defines a channel 26 for receiving a first portion 72 of a grounding tang 70 therein that will be described in detail later.

Figure 5:
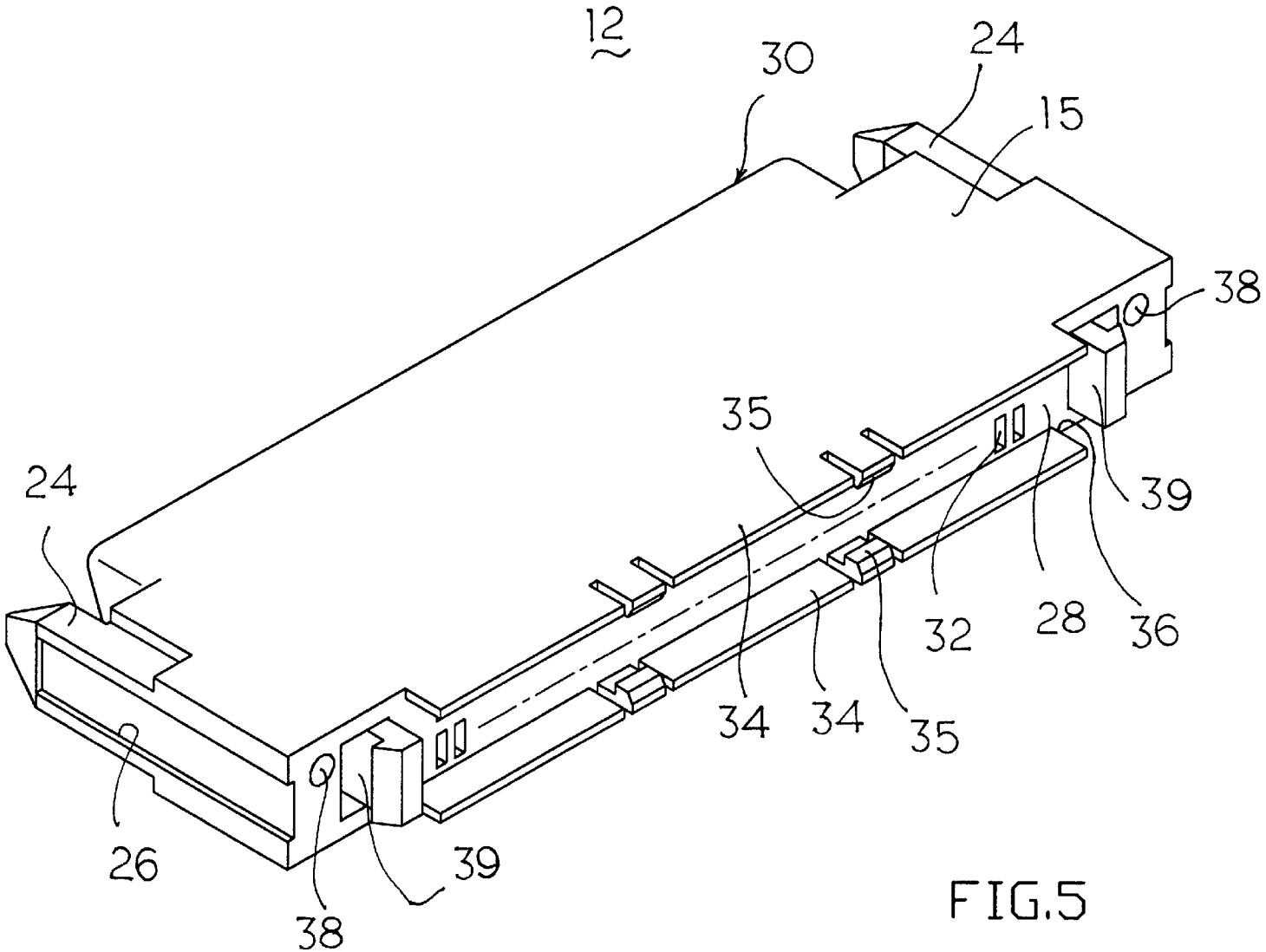
FIG. 5 is a back perspective view of the male section of the extender of FIG. 1.

Also referring to FIG. 5, the housing 16 further includes a first abutment surface 28 on the rear portion and a first mating port 30 about the circumferential wall 18. A plurality of first passageways 32 extend from the abutment surface 28 through the base 15 and into the blade 22 of the mating port 30 for each receiving a corresponding first male portion 82 of a contact 80 therein that will be described in detail later.

A pair of first latches 39 extend backward out of the abutment surface 28 adjacent two opposite ends of the base 15 for mutual engagement with another pair of latches 52 of the female section 14 for assembling the whole extender 10 together, that will be described in detail later.

A pair of restraint plates 34 with plural inward hooks 35 integrally extend rearward from two back side edges 36 for receipt within a pair of corresponding recesses 54 in the female section 14 that will be described in detail later.

A pair of polarization holes 38 extend inward/forward from the abutment surface 28 for receiving a pair of corresponding polarization posts 60 of the female section 14 that will described in detail later.

Figure 3:
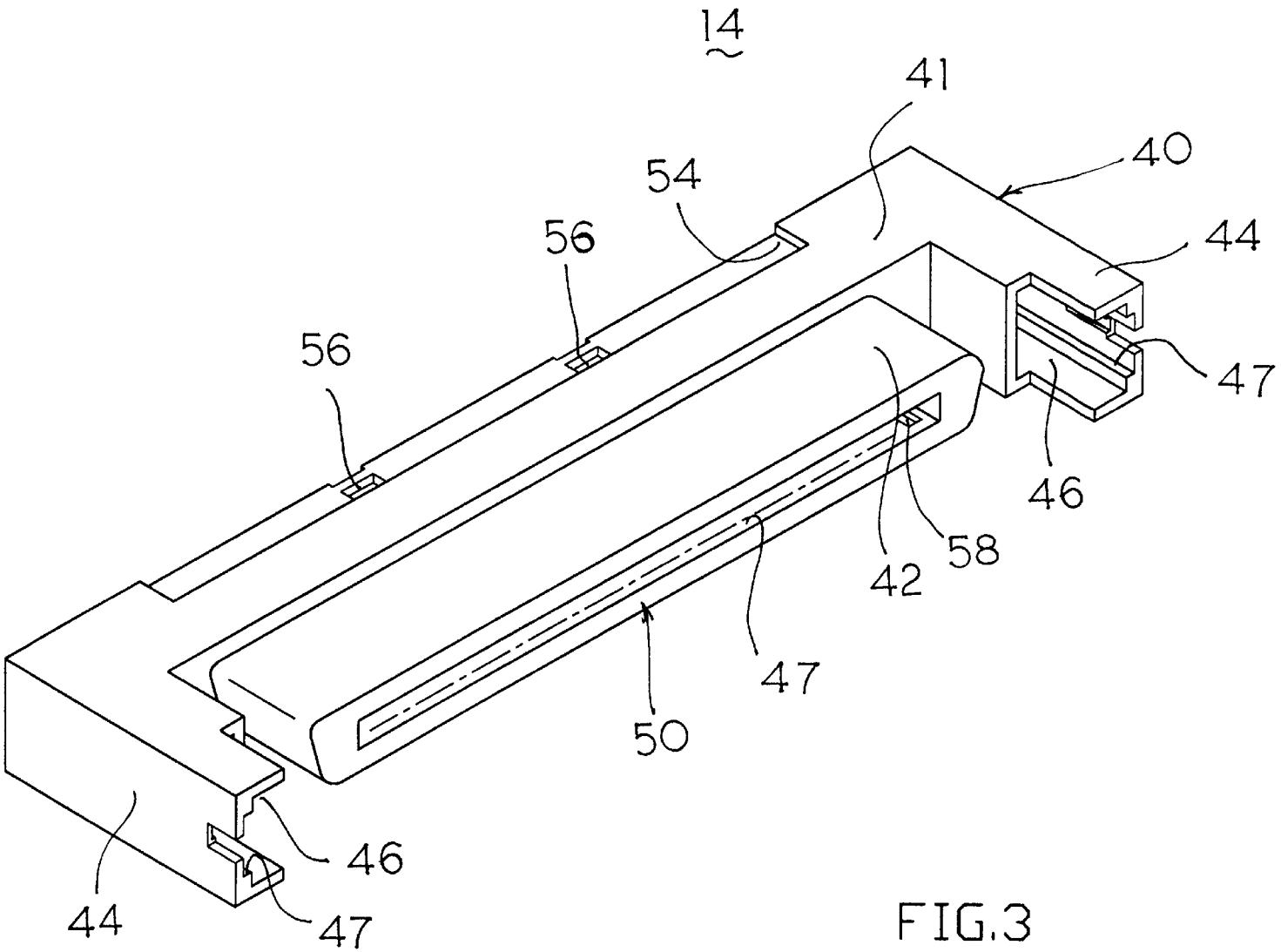
FIG. 3 is a front perspective view of the female section of the extender of FIG. 1.

Referring to FIG. 3, the female section 14 includes a second housing 40 with a second base 41 from which a second circumferential wall 42 forward extend whereby the circumferential wall 47 defines a second cavity 42 for receiving a corresponding blade of a male connector (not shown) mounted adjacent the front edge of the hard drive. A pair of tower 44 extend forward from two opposite ends of the housing 40 each defining an opening 46 with a second channel 47 therein for receiving a second portion 74 of the grounding tang 70.

Figure 2:
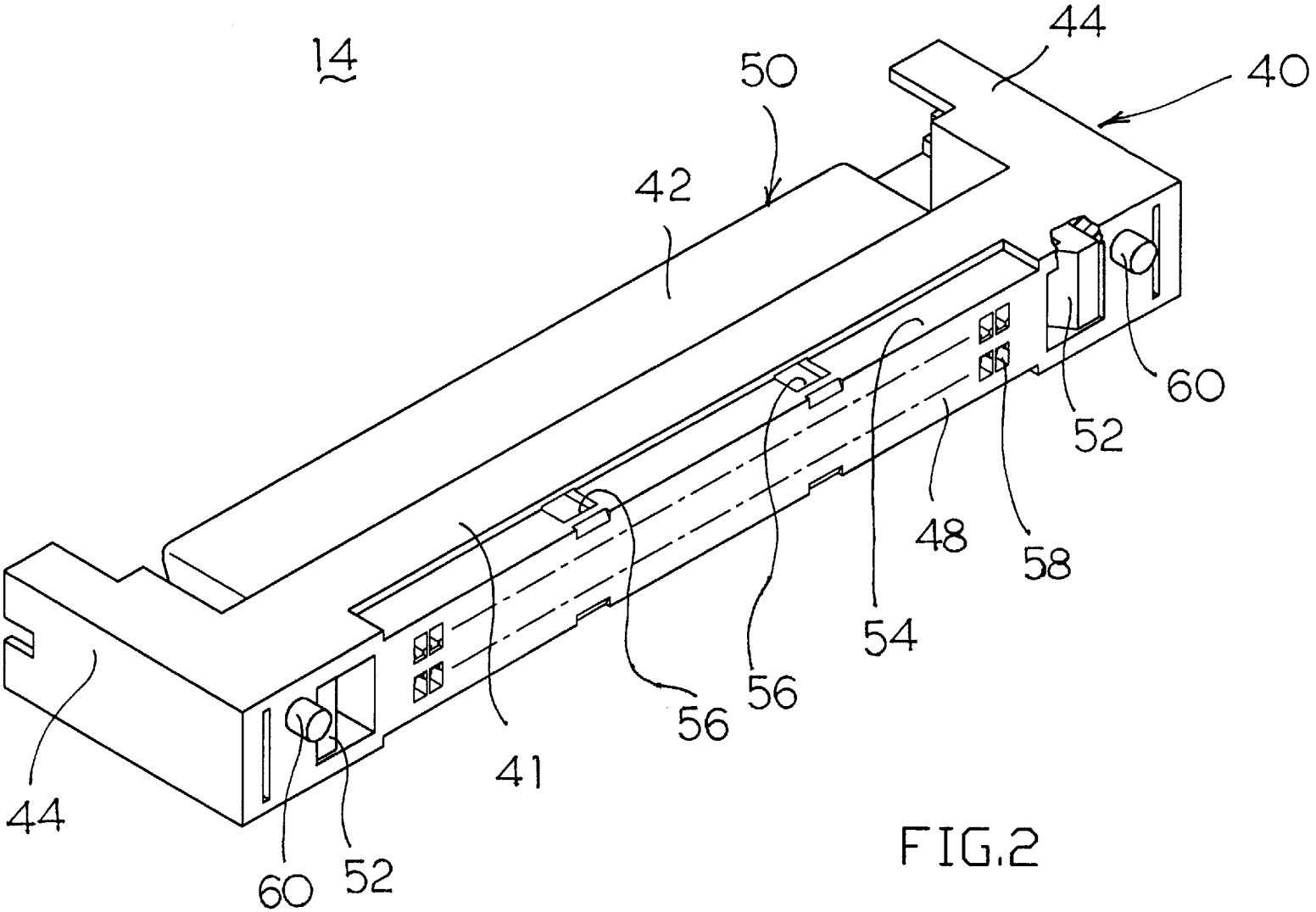
FIG. 2 is a back perspective view of the female section of the extender of FIG. 1.

Referring to FIG. 2, a second abutment surface 48 is provided on the rear portion of the female section 14 and a second mating port 50 generally defined by the second circumferential wall 42 is provided on the front portion, oppositely. A hidden second latch 52 is provided under the second abutment surface 48 for cooperative engagement with the corresponding first latch 39 of the male section 12 so as to fasten the male section 12 and the female section 14 together.

A pair of recesses 54 are provided on opposite side of the housing 40 adjacent the second abutment surface 48 for receivably engagement with the restraint plates 34 of the male section 12, respectively, wherein each recess 54 further includes indents 56 for latchably receiving the corresponding hooks 35 of the restraint plate 34 so as to serve as a secondary latch means for combining the male section 12 and the female section 14.

A plurality of second passageways 58 extend inward/forward from the second abutment surface 48 through the base 41 into the circumferential wall 42, and face to a center portion of the second cavity 42 whereby the second passageway 58 may receive a corresponding second female portion 84 of the contact 80.

A pair of polarization posts 60 extend backward from the abutment surface 48 for proper receipt within the corresponding pair of polarization holes 38 of the male section 12, respectively.

Figure 6:
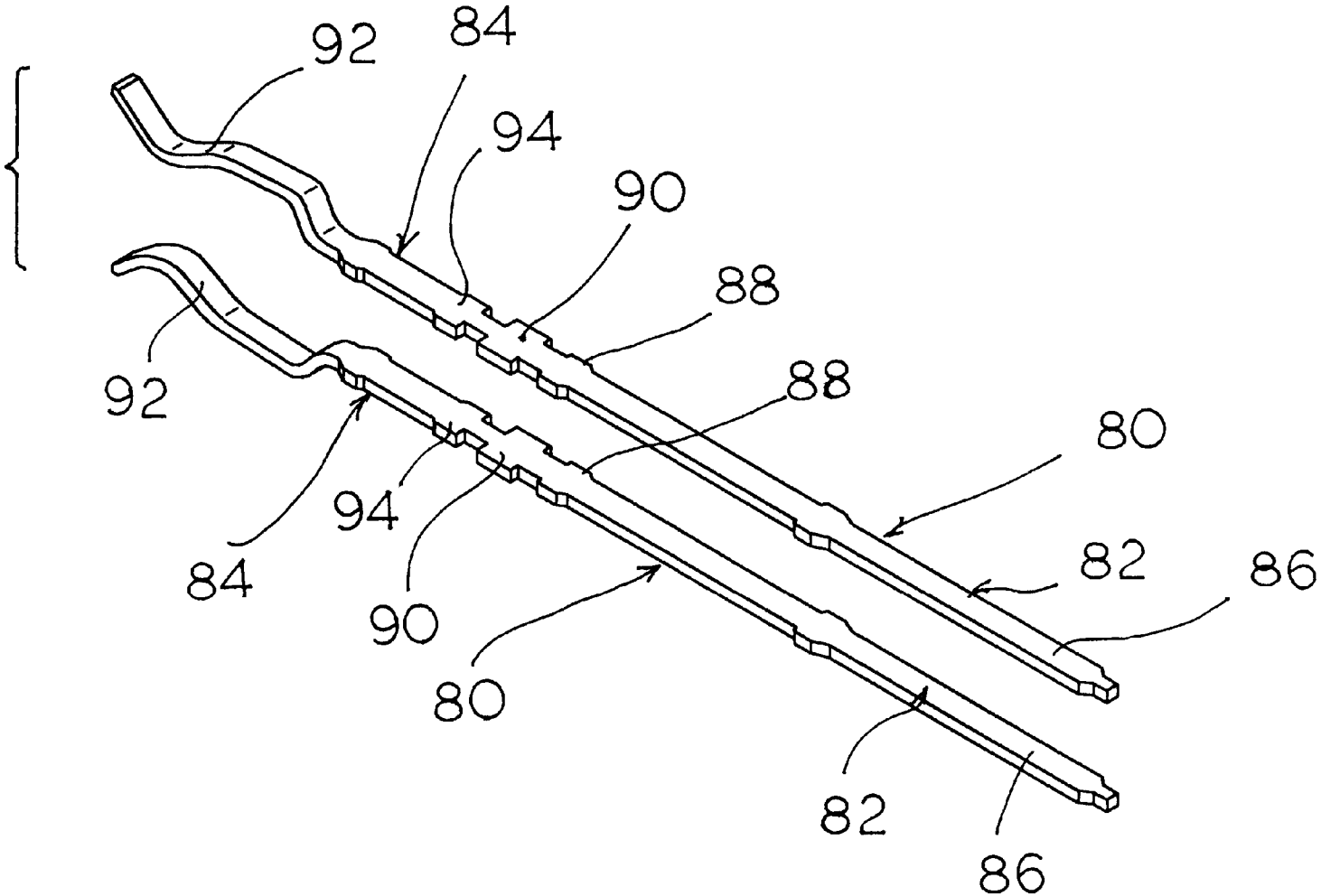
FIG. 6 is a perspective view of the pair of opposite contacts for use within the extender of FIG. 1.

As shown in FIG. 6, each contact 80 includes a first male portion 82 adapted to be received within the first passageway 32 of the male section 12 wherein the first male portion 82 of the contact 80 includes a first contact section 86, a first retention section 88 and a positioning section 90, whereby the positioning section 90 may be engagably received within a restraint area 33 (FIG. 8) in the first passageway 32 for orientation of the contact 80 along its lengthwise direction.

It should be noted that each first passageway 32 is substantially aligned with a corresponding second passageway 58 along their length direction, and the second, female portion 84, which includes a second contact section 92 and a second retention section 94, may be properly received therein.

It can be seen that the outwardly facing first contact section 86 of the first male portion 82, which are disposed on the blade 22 of the male section 12, is adapted to contact the corresponding female contact of the female connector mounted on the backplane (not shown). Oppositely, the inwardly facing second contact section 92 of the second female portion 84, which are received adjacent the inner surface of the second circumferential wall 42, may engage the male contact of the male connector mounted on the hard drive (not shown).

Figure 7:
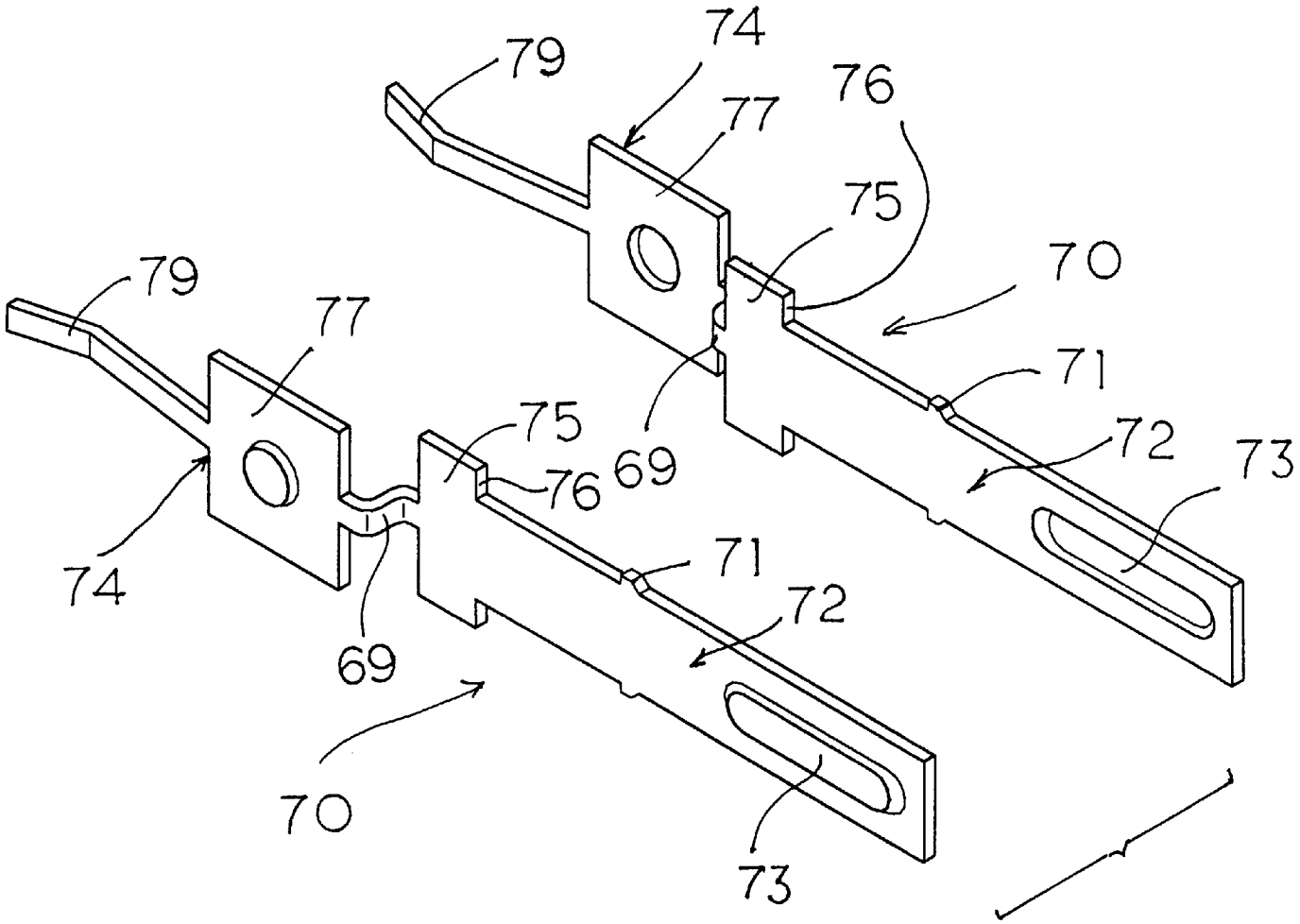
FIG. 7 is a perspective view of the pair of opposite grounding tangs for use with the extender of FIG. 1.

As shown in FIG. 7, the grounding tang 70 includes the first portion 72 with retention section 71 for interferential engagement within the channel 26 and a bumped portion 73 thereon for being adapted to engagement with a grounding tang in the female connector on the backplane (not shown). The first portion 72 further includes a stabilization section 75 with its edge 76 abutting against a step (not shown) in the channel 26.

Figure 8:
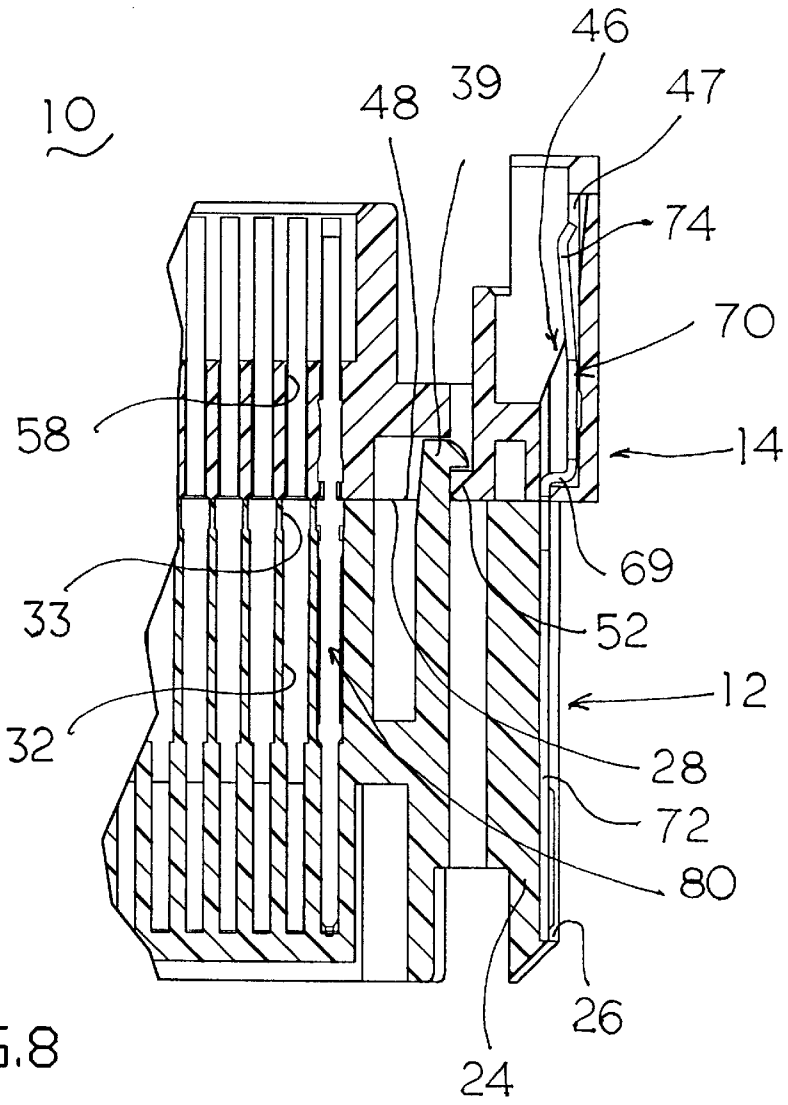
FIG. 8 is a partial cross-sectional view of the assembled extender to show how each contact is received in both the corresponding first passageway and the aligned second passageway.

The second portion 74 of the grounding tang 70 includes a seating portion 77 having edge 78 abutting against a step (not shown) in the opening 46 in the tower 44 of the female section 14. Referring to FIGS. 3 and 8, the opening 46 defines a second channel 47 for receiving the seating portion 77 of the second portion 74 of the grounding tang 70. Thus, an engagement section 79 which is positioned above the seating portion 77 extends inward and is adapted to engage a corresponding grounding tang of the male connector mounted on the hard drive (not shown). It can be noted that there is an offset section 69 positioned at the lower end of the second portion 74 of the grounding tang 70, so that the first portion 72 and the second portion 74 are not aligned in their lengthwise direction. This lateral offset provides the structural arrangement for allowing the outward facing first portion 72 to mate the inward facing grounding tang of the female connector mounted on the backplane (not shown), and the inward facing second portion 74 to mate the outward facing grounding tang of the male connector mounted on the hard drive (not shown).

Figure 9:
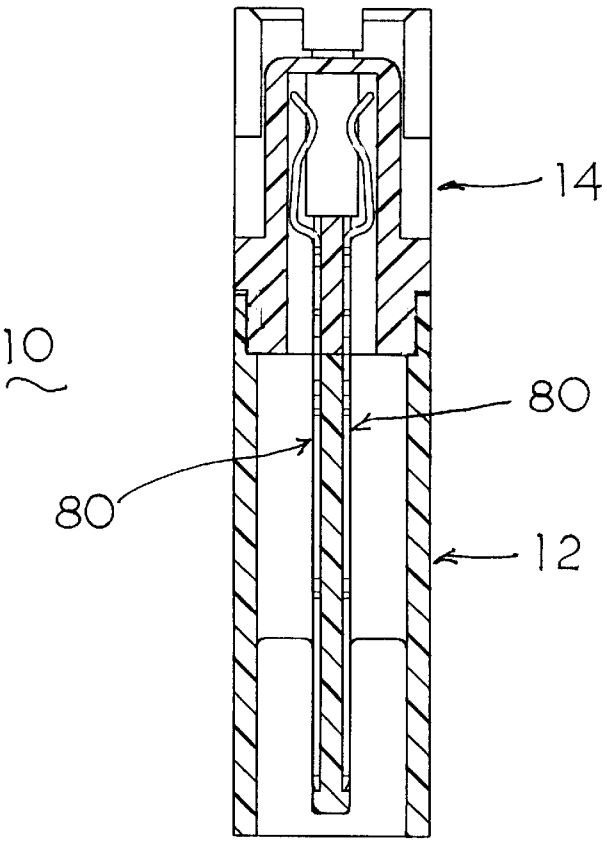
FIG. 9 is a partial cross-sectional view, cut away from another plane, of the assembled extender to show how the latches of the male connector and female connector are hooked with each other and how the contact is positioned in the extender.

When assembled, referring to FIGS. 8 and 9, each first male portion 82 of the contact 80 is inserted, from the back (i.e., the abutment surface 28), into the corresponding first passageway 32 in the male section 12 until the positioning section 90 has reached and occupied the restraint area 33, whereby each second female portion 84 of the contact 80 extends and suspends out of the first abutment surface 28. Also, the grounding tang 70 is loaded to the female section 14, from the forward (i.e., the port portion 30) into the opening 46 with is second portion 74 received within the second channel 47 whereby the first portion 72 of the tang 70 extends out of the second abutment surface 48.

Then, the first male section 12 and the second female section 14 are precisely back-to-back assembled to each other under the condition that not only the restraint plates 34 of the male section 12 are latchable received within the recesses 54 of the female section 14 by means that the hooks 35 of the plates 34 are engaged within the corresponding indents 56, but also the first latches 39 of the male section 12 extend beyond the second abutment surface 48 and latchably engages the hidden second latches 52 of the female section 14. The male section 12 and the female section 14 of the extender 10 so far are fastened with each other and accomplish their self-assembling.

It can be appreciated that when the male section 12 and the female section 14 are combined together, the second, female portion 84 of each contact 80, which originally suspensively extends out of the first abutment surface 28 of the male section 12, may properly be inserted into the corresponding second passageway 58 in the female section 14 and retained therein by means of the retention section 94. Similarly, the first portion 72 of the grounding tang 70 may be interferentially received within the corresponding channel 26 by the retention section 71. Till now, the first housing 16 of the male section 12 are securely assembled to the second housing 40 of the female section 14 with the grounding tangs 70 and the plural contacts 80 retained within the whole assembly, i.e., the extender 10.

It is also noted that as mentioned before, when assembled, the polarization posts 60 of the female section 14 are snugly received within the corresponding polarization holes 38 of the male section 12 for avoiding reverse assembling along the lengthwise direction of the first housing 16 and the second housing 40. Therefore, the whole assembly presents an easy-assembling, strong and reliable structural combination for functioning as an intermediate between the spaced male connector on the hard drive and female connector on the backplane.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

We claim:

1. An extender intermediating between a male connector and a female connector, comprising:

a male section defining a first housing with a plurality of first passageways extending therein;

a second section defining a second housing with a plurality of second passageways extending therein;

a corresponding number of contacts each including a first male portion and a second female portion adapted to be respectively received within the corresponding first passageway and second passageway; and the first housing and the second housing are fastened to each other in a back-to-back manner; wherein the first housing includes a first abutment surface and a pair of alignment posts, and the second housing includes a second abutment surface and a pair of towers, so that when said first housing and said second housing are fastened with each other in the back-to-back manner, the first abutment surface confronts the second abutment surface, and the pair of alignment posts extend away from said first abutment surface in a first direction, the pair of towers extend away from the second abutment surface in a second direction opposite to said first direction whereby each of said pair of alignment posts and the corresponding one of said pair of towers extend away from each other and commonly receive a grounding tang therein.

2. The extender as defined in claim 1, wherein the first housing further includes a pair of restraint plates extend backward from an abutment surface and the second housing further includes a pair of recesses for receiving said pair of restraint plates therein.

3. The extender as defined in claim 1, wherein the first housing further includes a first latch for latchable engagement with a second latch of the second housing.

4. The extender as defined in claim 1, wherein said grounding tang includes a first portion and a second portion with an offset section around an lower end of the second portion.

5. The extender as defined in claim 1, wherein the first housing includes a pair of polarization hole extending inward/forward from a first abutment surface thereof, and the second housing includes a pair of polarization posts extending outwward/backward from a second abutment surface therein.

6. An extender including a male section and a female section, comprising:

a grounding tang including:

a first portion received within a first channel of an alignment post of the male section positioned adjacent one end of said male section;

a second portion received within a second channel of a raised tower of the female section adjacent a corresponding end of the female section; and an offset section generally positioned adjacent a lower end of the second portion.

7. The grounding tang as defined in claim 6, wherein said offset section is positioned within said tower.

8. An intermediate device for use with a male connector and a female connector wherein said male connector and said female connector is adapted to be mated with each other, comprising:

a male section including a first housing which can be mated with the female connector; and a female section opposite to said male section in a back-to-back manner, said female section including a second housing which can be mated with the male connector;

said first housing defining a first circumferential wall with an horizontally extending blade and a pair of alignment posts positioned adjacent to two opposite ends of the first housing, said pair of alignment posts extending in the same direction with the first circumferential wall;

said second housing defining a second circumferential wall and a pair of raised towers positioned adjacent to two opposite ends of the second housing, said pair of towers extending in the same direction of the second circumferential whereby when the first housing and the second housing are back to back fastened with each other, the first housing and the second housing side by side mutually outward extend in opposite directions for mating with the female connector and the male connector, respectively.

* * * * *